US008844513B2

(12) United States Patent
LaMunyon, III

(10) Patent No.: US 8,844,513 B2
(45) Date of Patent: Sep. 30, 2014

(54) APPARATUS, SYSTEM AND METHOD FOR HEATING A VENTILATION SYSTEM

(76) Inventor: John Stock LaMunyon, III, Sandy, UT (US)

( * ) Notice: Subject to any disclaimer, the term of this patent is extended or adjusted under 35 U.S.C. 154(b) by 1206 days.

(21) Appl. No.: 12/168,422

(22) Filed: Jul. 7, 2008

(65) Prior Publication Data

US 2010/0000513 A1 Jan. 7, 2010

(51) Int. Cl.
*F23J 11/00* (2006.01)
*F23J 13/00* (2006.01)

(52) U.S. Cl.
CPC ..... *F23J 13/00* (2013.01); *F23J 2900/13002* (2013.01)
USPC ..... 126/80; 126/299 R; 126/301; 126/307 R; 126/312; 126/307 A; 126/500; 165/128; 165/129; 454/43; 219/535; 219/201

(58) Field of Classification Search
USPC ..... 126/312, 307 R, 21 R, 21 A, 299 F, 500, 126/299 R, 301, 307 A, 80; 165/128, 156, 165/129, 154, 66; 219/201, 213, 535, 521; 392/363, 478, 483; 454/43; 110/147
See application file for complete search history.

(56) References Cited

U.S. PATENT DOCUMENTS

| | | | | | |
|---|---|---|---|---|---|
| 189,054 | A | * | 4/1877 | Moore | 454/43 |
| 751,143 | A | * | 2/1904 | Brannock | 126/312 |
| 1,114,640 | A | * | 10/1914 | O'Brien | 454/43 |
| 1,389,252 | A | * | 8/1921 | Lucas | 454/43 |
| 1,401,500 | A | * | 12/1921 | Scott | 338/55 |
| 1,759,830 | A | * | 5/1930 | Blanchard | 219/201 |
| 2,421,519 | A | * | 6/1947 | Penk | 337/24 |
| 2,802,084 | A | * | 8/1957 | Marklew | 219/629 |
| 3,985,994 | A | * | 10/1976 | Eloranta et al. | 219/201 |
| 4,192,988 | A | * | 3/1980 | Pederson et al. | 219/201 |
| 4,213,947 | A | * | 7/1980 | Fremont et al. | 423/245.3 |
| 4,306,491 | A | * | 12/1981 | Reardon, Jr. | 454/12 |
| 4,512,264 | A | * | 4/1985 | Crawford | 110/160 |
| 4,524,262 | A | * | 6/1985 | Meyer | 219/213 |
| 4,874,191 | A | * | 10/1989 | Green | 285/332.3 |
| 4,920,866 | A | * | 5/1990 | Hoban | 454/43 |
| 5,038,420 | A | * | 8/1991 | Chen | 4/538 |
| 5,329,920 | A | * | 7/1994 | Brazier | 126/344 |
| 5,467,697 | A | * | 11/1995 | Hunziker | 99/449 |
| 5,499,622 | A | * | 3/1996 | Woods | 126/500 |
| 5,591,367 | A | * | 1/1997 | Schwarzkopf | 219/535 |
| 6,000,391 | A | * | 12/1999 | Timmons | 126/307 R |
| 6,097,008 | A | * | 8/2000 | Mahin | 219/523 |

(Continued)

*Primary Examiner* — Kenneth Rinehart
*Assistant Examiner* — Sharla Magana
(74) *Attorney, Agent, or Firm* — Clayton, Howarth & Cannon, P.C.

(57) ABSTRACT

A device, system and method for heating fluid (air) in a flue to create a draw prior to combusting a fuel in a combustion device. The device, system and method includes a housing that may be integrated about the flue. The housing may include a heat exchanger that itself may include a heating source that may be in thermal communication with the flue and a temperature differentiation driver. The heat exchanger may operate to transfer heat energy from the heating source to a fluid constrained to a path created by the flue. The result is a pressure differential created within the flue to help draw the fluid out of the combustion device. The heat exchanger may be configured such that it may cause heat transfer to the heavier, more dense fluid contained within the ventilation system prior to combusting fuel in a combustion device, thereby causing the fluid to be relatively less dense thus creating a draw.

11 Claims, 13 Drawing Sheets

(56) References Cited

U.S. PATENT DOCUMENTS

| | | | | |
|---|---|---|---|---|
| 6,141,495 | A * | 10/2000 | Roth | 392/363 |
| 6,336,003 | B1 * | 1/2002 | Mitsunaga et al. | 392/470 |
| 6,431,124 | B2 * | 8/2002 | Kwon | 122/13.3 |
| 6,463,212 | B1 * | 10/2002 | Salyer | 392/341 |
| 6,769,461 | B1 * | 8/2004 | Lee | 141/65 |
| 6,861,144 | B2 * | 3/2005 | Wakamatsu et al. | 428/402 |
| 2005/0229923 | A1 * | 10/2005 | Barry et al. | 126/312 |
| 2007/0207718 | A1 * | 9/2007 | Heise | 454/43 |
| 2008/0271726 | A1 * | 11/2008 | Jacklich et al. | 126/80 |

* cited by examiner

APPARATUS, SYSTEM AND METHOD FOR HEATING A VENTILATION SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

The disclosure relates generally to combustion devices, such as wood burning stoves, fireplaces or other heating appliances, and ventilation systems, such as a flue and associated components, and more particularly, but not necessarily entirely, to a device, system and method for heating a portion of a ventilation system that may be part of a combustion device.

Combustion devices, such as wood burning stoves, fireplaces or other heating appliances that burn fuel, are commonly used to provide heat to a home or other building. Such combustion devices are commonly attached or connected to a ventilation system, including a flue. As used herein the term "flue" refers broadly to a passageway that takes combustion gases or exhaust from the combustion device to the venting system, which communicates with the outside air. Thus, it will be appreciated that a flue may be a part of a chimney or any ventilation system that is used in conjunction with a combustion device.

A common problem associated with combustion devices connected to a flue is that smoke or other combustion gases often escape from the combustion device into the room that the combustion device is located in instead of exiting through the flue. This problem is due to cold air located inside the flue, having a greater density than the air in the room. This density difference results in smoke or other combustion gases not being able to displace the more dense or heavier air in the flue, such that the smoke or combustion gases are not able to be drawn upward through the flue and outside. Once the flue is heated sufficiently, the smoke or combustion gases are then able to be drawn upward through the flue and outside.

The smoke or other combustion gases often provide an unpleasant odor in the room creating an annoyance for owners of homes or other buildings that use combustion devices. There is a long felt, but unmet, need for a device, system and method that is relatively inexpensive to make and simple in operation that will prevent the above stated problem of smoke or other combustion gases escaping from the combustion device into the room.

The devices, systems and methods known in the industry may be characterized by several disadvantages that may be addressed by this disclosure. This disclosure minimizes, and in some aspects eliminates, at least some of the failures and other problems, by utilizing the structural and functional features of the devices, systems and methods described in this disclosure.

The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
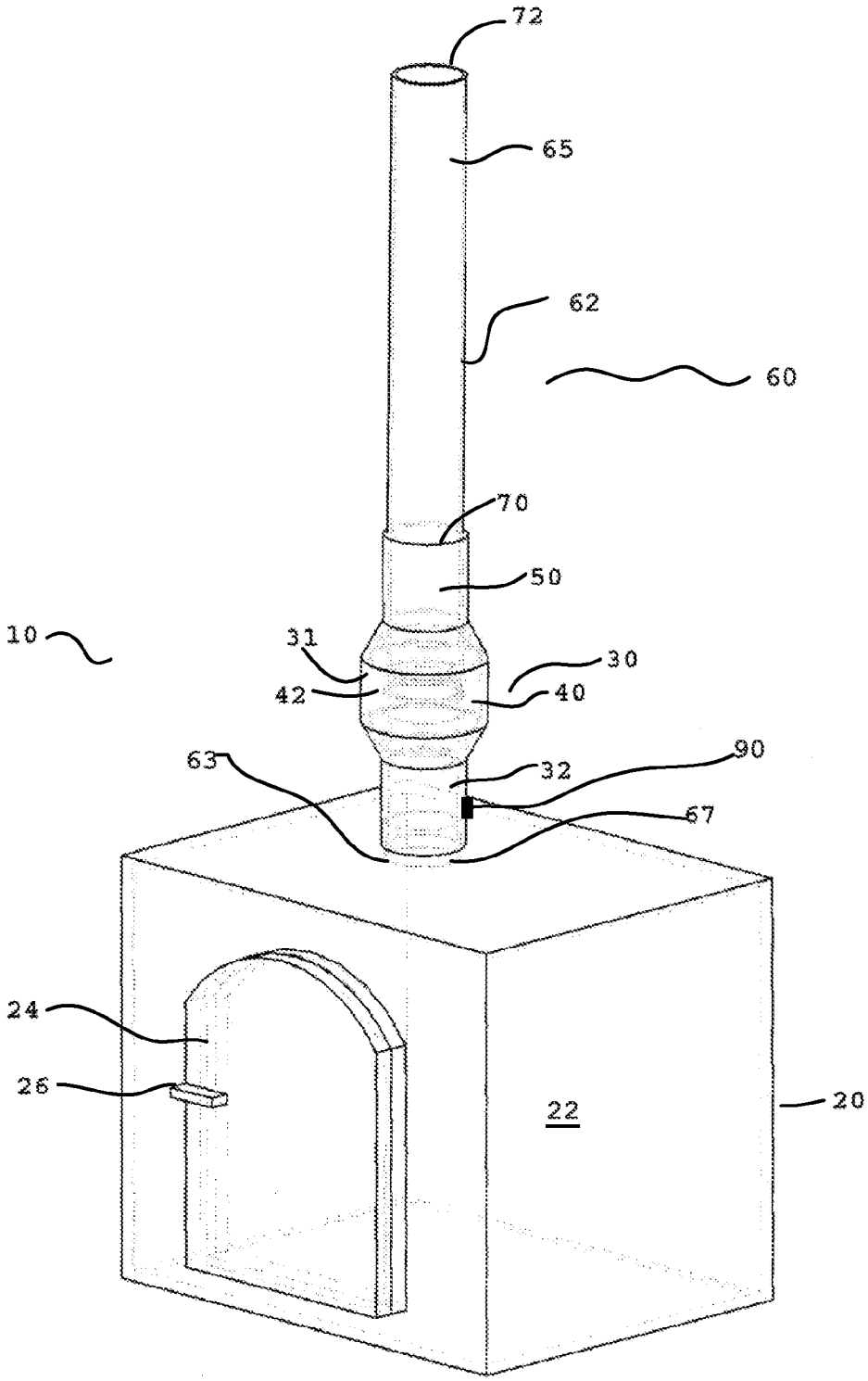
FIG. 1 is a perspective view of a device and system for heating fluid in a flue in accordance with the principles of this disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

Before the present devices, systems and methods for heating fluid, such as air, in a flue are disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the disclosure will be limited only by the appended claims and equivalents thereof.

In describing and claiming the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps.

As used herein, the phrase "consisting of" and grammatical equivalents thereof exclude any element, step, or ingredient not specified in the claim.

As used herein, the term "proximal" shall refer broadly to the concept of a portion that lies nearest the midline or center of the body portion. Conversely, the term "distal" shall refer broadly to the opposite of "proximal" to a concept of a portion that lies farther away from the midline or center of the body portion than another portion.

Applicant has discovered a device, system and method for heating fluid in a flue to create a draw prior to combusting or burning fuel in a combustion device. The result is that the amount of smoke or other combustion gases caused from combusting or burning fuel within the combustion device is limited, such that a minimal amount of smoke or other combustion gases may enter the room in which the combustion device resides. Such a device, system and method as disclosed herein may help reduce the amount of odor due to the reduction of smoke or other combustion gases in the room thereby increasing the enjoyment of using a combustion device.

Applicant has thus conceived of a heating device, system and method capable of producing a pressure differential within the flue whereby the fluid (air) may be drawn out of the combustion device creating a draw. Further, Applicant has conceived of a heating device, system and method capable of heating the heavier, more dense fluid (air) contained within the flue prior to combusting fuel in a combustion device, thereby causing the fluid (air) to be relatively less dense thus creating a draw. By using the heating device, system and method of the disclosure, at the time when fuel is combusted in the primary combustion device a draw is already present, thereby directing smoke or other initial combustion gases to flow through the flue in a desired direction.

Figure 2:
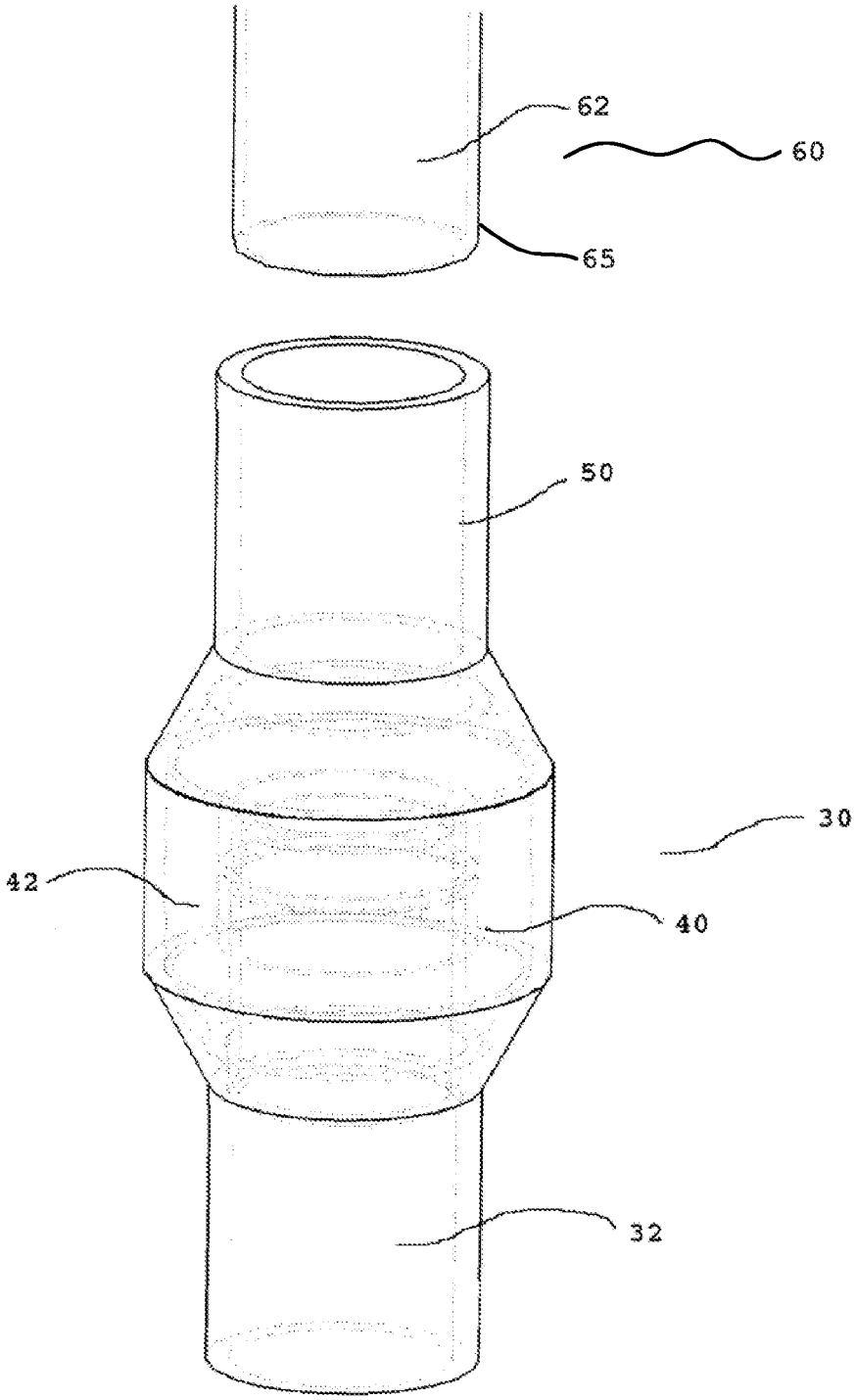
FIG. 2 is a front, perspective view of a device for heating fluid in a flue in accordance with the principles of this disclosure.
Figure 3:
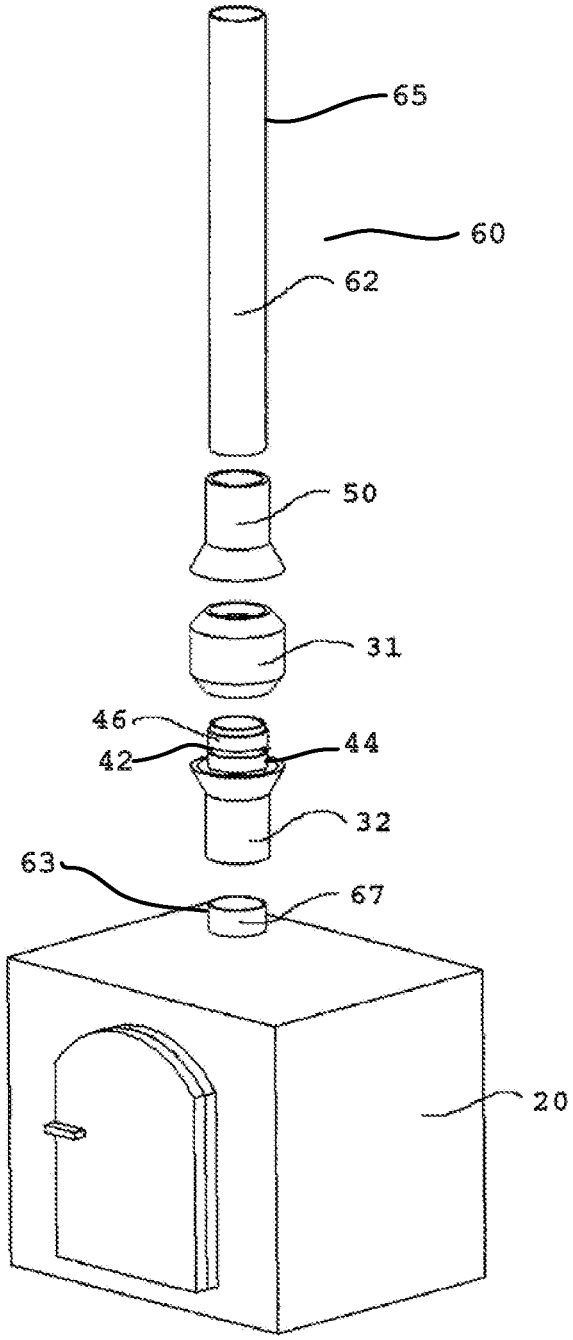
FIG. 3 is an exploded, perspective view of a device and system for heating fluid in a flue in accordance with the principles of this disclosure.

Referring now to the embodiment of FIGS. 1-3, wherein a system 10 for heating a flue of a ventilation system is illustrated. The system 10 for heating fluid within a flue 62 may include a combustion device 20, a housing 30, a ventilation system 60 and a damper that may be used to regulate the flow of air in a combustion device 20.

The combustion device 20 may include a chamber 22 for combusting fuel, a door 24 or other portal device for permitting fuel or other objects to be added into the chamber 22 and a latch 26 for maintaining the door 24 or other portal device in a closed position. It will be appreciated that any combustion device 20 may be used without departing from the spirit or scope of the disclosure. For example, the combustion device 20 may be a wood burning stove, a fireplace, a heating appliance or any other device capable of combusting fuel.

The housing 30 may comprise a main body portion 31, a first portion 32, a heat exchanger 40, a second portion 50, and an elongated portion 42 (illustrated best in FIG. 3). The above components of the housing 30 may form at least part of the device or unit for heating the fluid within the flue 62.

Figure 6:
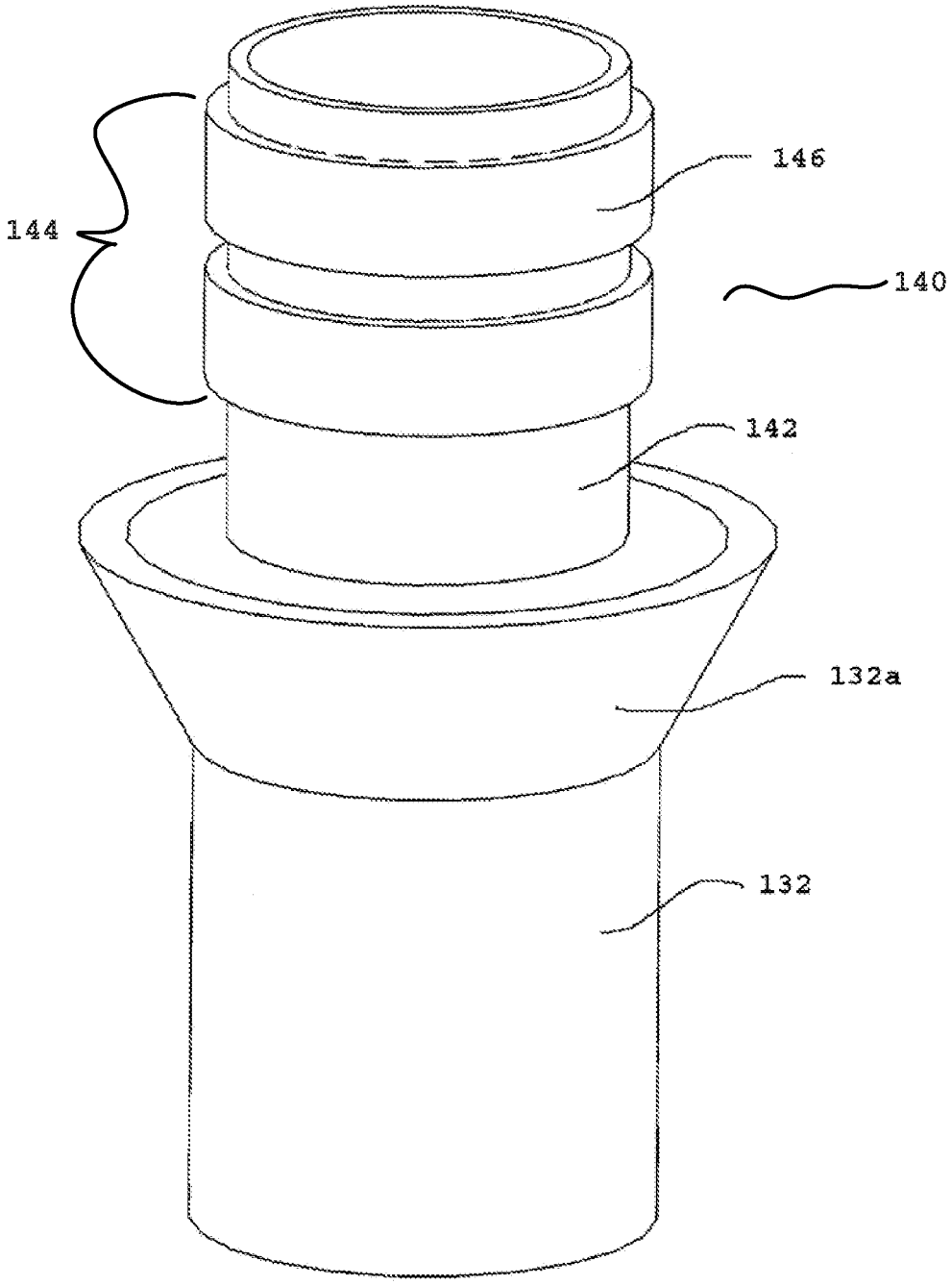
FIG. 6 is a perspective view of a device for heating fluid in a flue in accordance with the principles of this disclosure.
Figure 8:
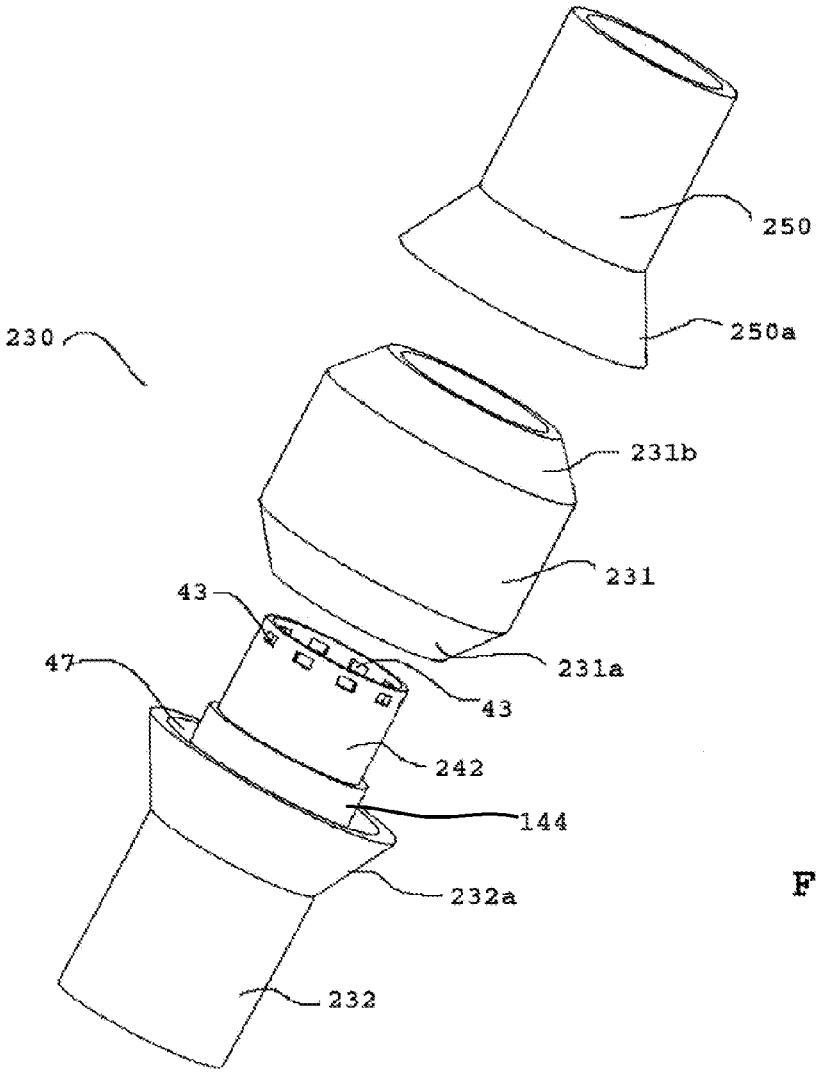
FIG. 8 is an exploded perspective view of a device for heating fluid in a flue in accordance with the principles of this disclosure.

The elongated portion 42 may be substantially hollow. The elongated portion 42 may be formed as an integral piece with either the first portion 32 or the second portion 50 (as illustrated in FIG. 3). Alternatively, the elongated portion 42 may be a separate piece that is connectable or attachable to either the first portion 32 or the second portion 50, such that the first portion 32 or the second portion 50 operates in a unitary manner with the elongated portion 42 (as illustrated in FIG. 6). The elongated portion 42 may include a single hole 43 for ventilating the system or it may include a plurality of holes 43 for ventilating the system as illustrated in FIG. 8. The at least one hole 43 or the plurality of holes 43 allow the heat energy to easily access an inner part of the flue to heat the air inside the flue. In other words, heat energy may be allowed to access the inner part of the flue due, at least in part, to the presence of the hole 43 or plurality of holes 43, such that heat energy may be transferred to the heavier, dense fluid inside the flue.

The heat exchanger 40 may include a heating source 44 that may be in thermal communication with the combustion device 20 and the ventilation system 60. As used herein, the phrase "heat exchanger" refers broadly to any device that transfers heat energy from a source to a conveying medium. Heat energy may be transferred from the heat source 44 to the fluid (air) through conduction, radiation, convection or any of combination of these modes of heat transfer. For example, heat energy may initially be transferred through conduction and radiation until convection occurs. As the heat source transfers heat energy to the surrounding fluid (air) via conduction and radiation the fluid (air) in the ventilation system 60 is heated. Because the colder fluid (air) is more dense than the heated fluid (air), the colder fluid (air) replaces the heated fluid thereby causing circulation of the fluid (air) through convection.

The heat exchanger 40 may operate to transfer heat energy from the heating source 44 to a fluid medium that is constrained to or by a path that may be created by the presence of the ventilation system 60. The fluid may be constrained to or by the flue 62, or other parts of the ventilation system 60, to produce a pressure differential within the ventilation system 60, such that the fluid is able to be drawn out of the ventilation system 60 and the combustion device 20. The heat exchanger 40 may be configured and dimensioned such that it may cause heat transfer to the heavier, more dense fluid contained within the ventilation system 60 prior to combusting fuel in a combustion device, thereby causing the fluid to be relatively less dense thus creating a draw. The heat exchanger 40 may be configured such that it produces heat energy in a sufficient quantity to overcome an amount of heat energy leaving the entire system 10 due to heat loss between the heat exchanger 40 and the ventilation system 60, thereby permitting fluid movement through convection.

The heating source 44 may include a temperature differentiation driver 46 used to heat the fluid in at least a part of the ventilation system 60. The temperature differentiation driver 46 may be electrically or chemically based. One example of an electrically based temperature differentiation driver may be heat tape that is electrically charged. One example of an electrically based temperature differentiation driver may a heating coil or heating element. One example of an electrically based temperature driver may be solar power that is harnessed into electricity and used to drive the temperature differentiation in the system. It will be appreciated that there are other examples of electrically based temperature differentiation drivers that may be used by the disclosure without departing from the spirit or scope of the disclosure.

Examples of chemically based temperature differentiation drivers may be petroleum, a petroleum based gel that will ignite and burn, natural gas, or natural gas components, such as methane, ethane, propane, butane and pentane. It will be appreciated that there are other examples of chemically based temperature differentiation drivers that may be used by the disclosure without departing from the spirit or scope of the disclosure. When using a chemical based temperature differentiation driver, the housing device 30 may include a gas attachment site and gas attachment mechanism for hooking the housing device 30 to a gas source, such as a natural gas line or other source, or the housing device 30 may include a basin 47 for holding liquids or gels. It will be appreciated that the natural gas hook up or the basin may be provided as part of the first portion 32, or the second portion 50 without departing from the spirit or scope of the disclosure.

Figure 7:
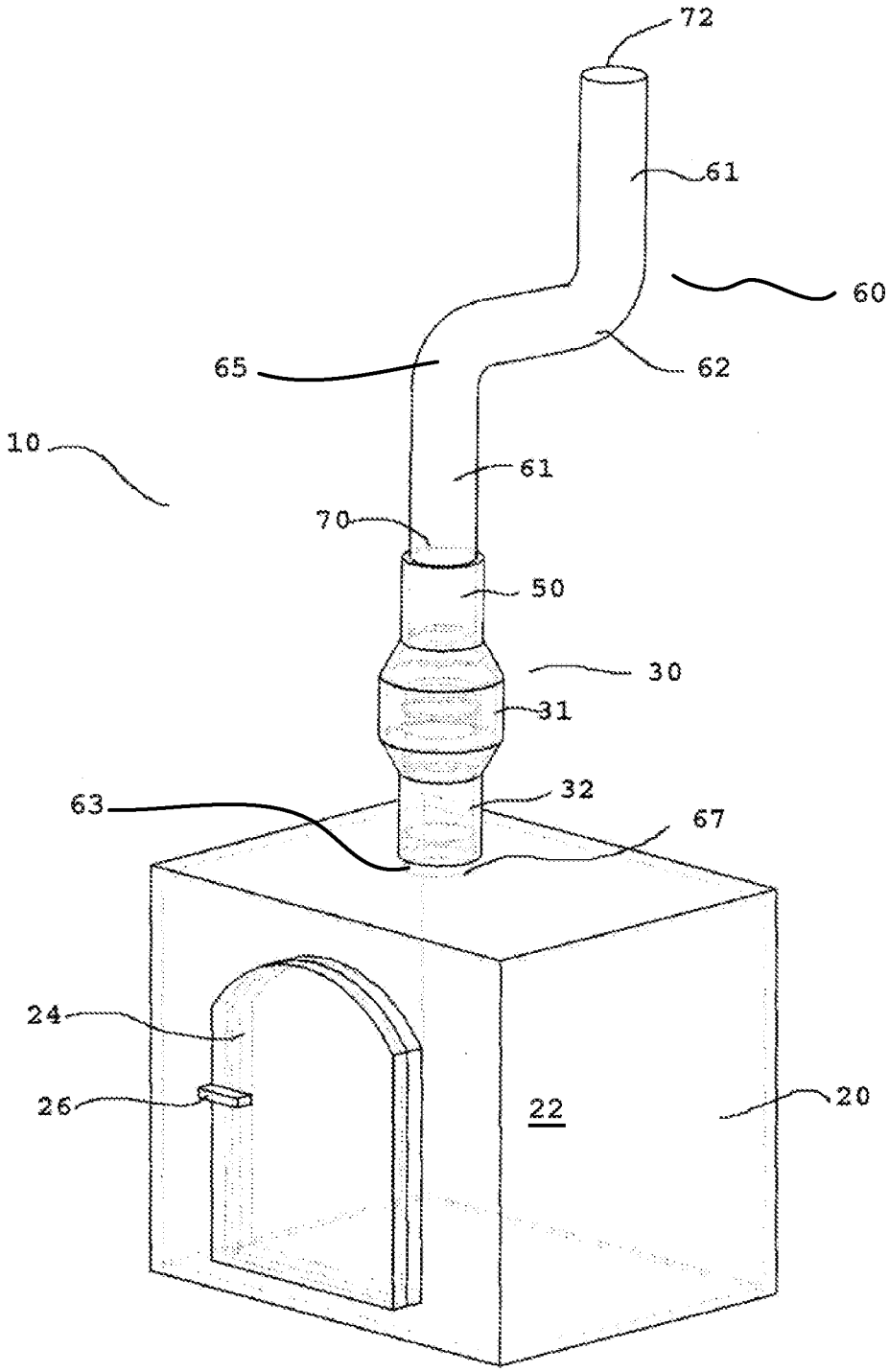
FIG. 7 is a perspective view of a device and system for heating fluid in a flue in accordance with the principles of this disclosure.

The ventilation system 60 may be a direct vent system or any other vent system known or that may become known in the relevant industry. The ventilation system 60 may comprise the flue 62, which may include a venting system having an intake vent for fresh air and a combustion gas vent to release the combustion gases to the outside. The ventilation system 60 may include a single flue pipe 61 or may include a plurality of flue pipes 61 that may be connected or attached together (as illustrated in FIG. 7) without departing from the spirit or scope of the disclosure. The ventilation system 60 may comprise structure 67, such as pipe and an attachment mechanism, for attaching the ventilation system 60 to the combustion device 20. The ventilation system 60 may be any ventilation system that is used in the relevant industry without departing from the spirit or scope of the disclosure. The flue 62 may comprise a first portion 63 and a second portion 65. The first portion 63 of the flue 62 may be attached to the combustion device 20 and may include about one inch to about forty-eight inches in length of the flue 62. Conversely, the second portion 65 of the flue 62 may be attached to the first portion 63 or to the housing device 30 and may include the remaining length of the flue to the exit 72 of the flue 62. Thus, the second portion 65 may be about twenty-four to about sixty inches in length of the flue 62.

It will be appreciated that the housing 30 may be located within the first portion 63 of the flue 62 or the housing 30 may be located within the second portion 65 of the flue 62. The housing 30 may be located anywhere between the combustion device 20 and the ceiling of the room in which the housing device 30 is used. The housing 30 may be located directly above the combustion device 20 within a range of about one inch to about forty-eight inches, or about six inches to about thirty-six inches. The housing 30 may be located a distance from the ceiling within a range of about three inches to about thirty-six inches from the ceiling or about six inches to about twenty-four inches from the ceiling.

It will be appreciated that the door 24 to the combustion device 20 may be part of a regulating system that regulates the temperature within the ventilation system 60. The heat exchanger 40 may comprise a regulator 90, such as a timer device, such that the heat source 44 may be operable for a unit of time, for example ten minutes, and then is shut off by the regulator 90. The heat exchanger 40 may comprise a regulator 90, such as a thermal regulator, such that the heat source is operable until a certain temperature is reached and then is shut off by the regulator 90. It will be understood that the heating source 44 of the heat exchanger 40 may produce a temperature within a range of about 150 degrees to about 800 degrees Fahrenheit, thereby transferring heat energy from the heating source 44 to the fluid. The heat exchanger 40 may comprise a regulator 90 that maintains a temperature differential, such that at a base 70 of the ventilation system 60 there is a greater temperature than at an exit 72 of the ventilation system 60, such that there is a continuous draw from the combustion device 20 to the exit 72 of the ventilation system 60.

Figure 4:
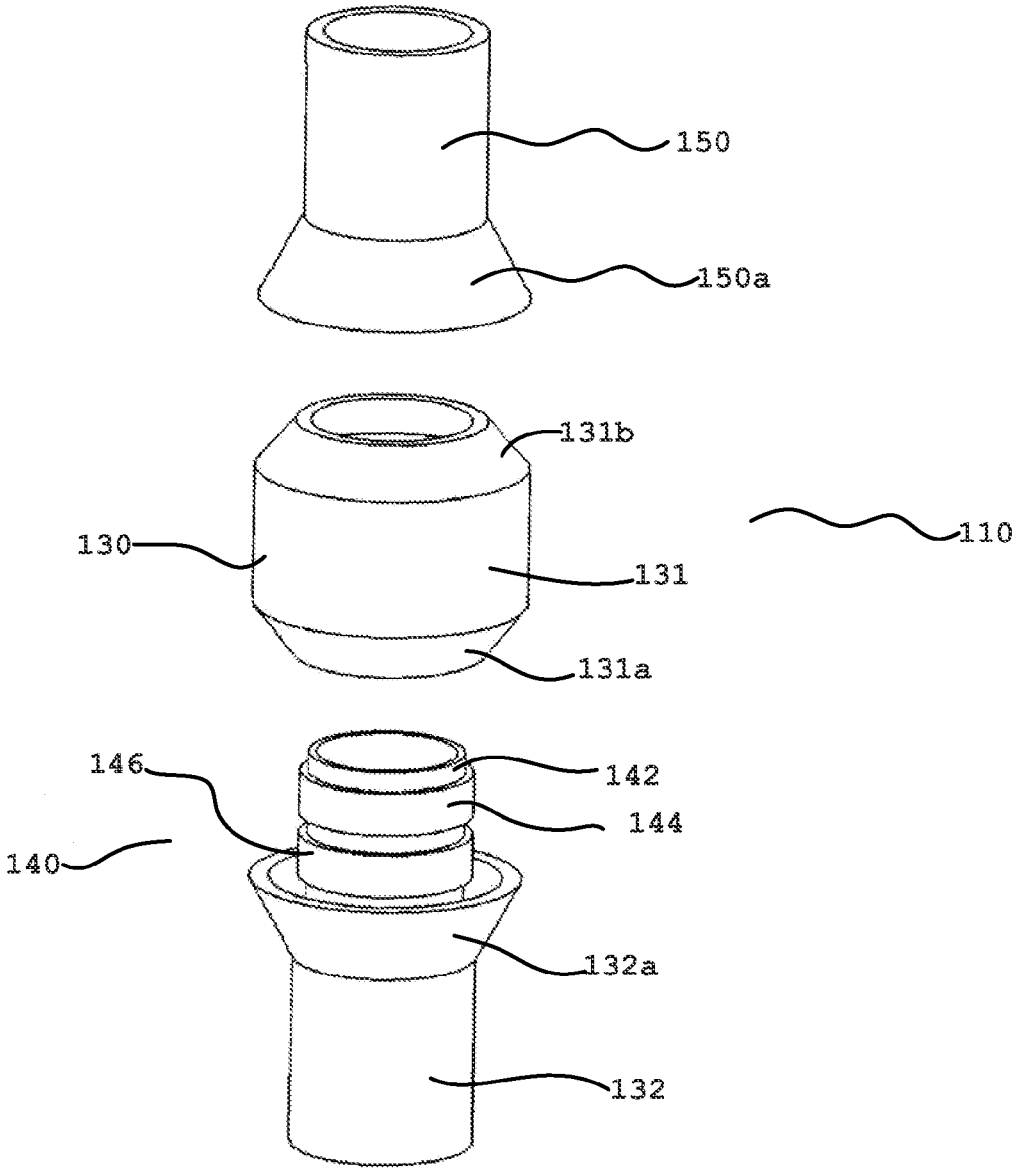
FIG. 4 is an exploded, perspective view of a device for heating fluid in a flue in accordance with the principles of this disclosure.
Figure 5:
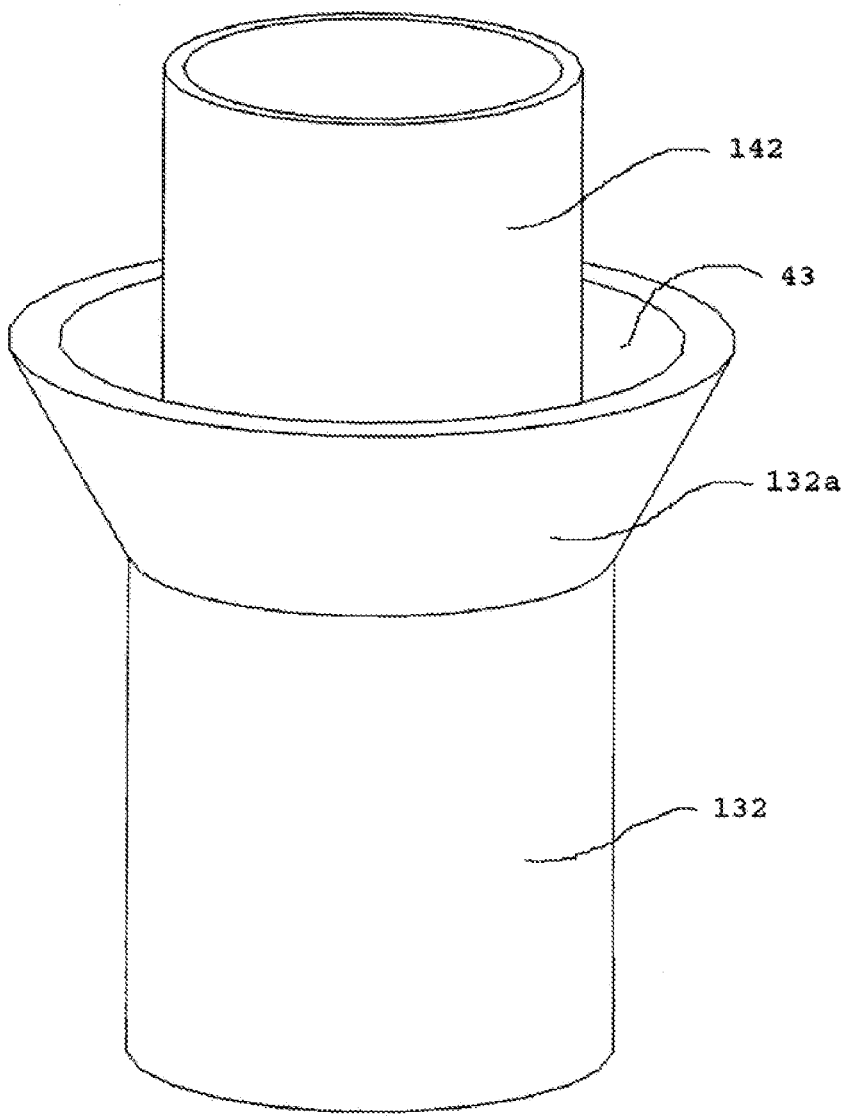
FIG. 5 is a perspective view of a device for heating fluid in a flue in accordance with the principles of this disclosure.

It will be appreciated that the embodiment of the disclosure illustrated in FIGS. 4-6 contains many of the same structures represented in FIGS. 1-3. New or different structures will be explained to most succinctly describe the additional advantages that come with the embodiment of the disclosure illustrated in FIGS. 4-6.

Referring now to FIGS. 4-6, a device 110 for heating a flue 62 attached to a combustion device 20 is illustrated. The device 110 may include a housing 130 that may be configured for integration about the flue 162. The device 110 may further include a main body portion 131, a first portion 132, a heat exchanger 140, a second portion 150, and an elongated portion 142. The above components of the housing 130 may form at least part of the device 110 or unit for heating the fluid within the flue 62.

The main body portion 131 may comprise a first tapered surface 131*a* and a second tapered surface 131*b*, which may be located at each end of the main body portion 131. The first portion 132 and the second portion 150 may each comprise a tapered surface 132*a* and 150*a*, respectively, at one end, such that the tapered surface 132*a* of said first portion 132 may matingly engage the first tapered surface 131*a* of said main body portion 131 and the tapered surface 150*a* of said second portion 150 may matingly engage the second tapered surface 131*b* of said main body portion 131 to create a unitary device when assembled.

The elongated portion 142 may be substantially hollow. The elongated portion 142 may be formed as an integral piece with either the first portion 132 or the second portion 150 as illustrated in FIGS. 4 and 5. Alternatively, as illustrated in FIG. 6, the elongated portion 142 may be a separate piece that is connectable or attachable to either the first portion 132 or the second portion 150, such that the first portion 132 or the second portion 150 operates in a unitary manner with the elongated portion 142. In either embodiment, the elongated portion 142 may include a single hole for ventilating the system or it may include a plurality of holes for ventilating the system, as illustrated in FIG. 8.

The heat exchanger 140 may include a heating source 144 that may be in thermal communication with the combustion device 20 and the ventilation system 60. As used herein, the phrase "heat exchanger" refers broadly to any device that transfers heat energy from a source to a conveying medium. Heat energy may be transferred from the heat source 144 to the fluid (air) through conduction, radiation, convection or any of combination of these modes of heat transfer. For example, heat energy may initially be transferred through conduction and radiation until convection occurs. As the heat source transfers heat energy to the surrounding fluid (air) via conduction and radiation the fluid (air) in the ventilation system 60 is heated. Because the colder fluid (air) is more dense than the heated fluid (air), the colder fluid (air) replaces the heated fluid thereby causing circulation of the fluid (air) through convection.

The heat exchanger 140 may operate to transfer heat energy from the heating source 144 to a fluid medium that is constrained to or by a path that may be created by the presence of the ventilation system 60. The fluid may be constrained to or by the flue 62, or other parts of the ventilation system 60, to produce a pressure differential within the flue of the ventilation system 60, such that the fluid is able to be drawn out of the ventilation system 60 and the combustion device 20. The heat exchanger 140 may be configured and dimensioned such that it may cause heat transfer to the heavier, more dense fluid contained within the ventilation system 60 prior to combusting fuel in a combustion device, thereby causing the fluid to be relatively less dense thus creating a draw. The heat exchanger 140 may be configured such that it produces heat energy in a sufficient quantity to overcome an amount of heat energy leaving the entire system due to heat loss between the heat exchanger 140 and the ventilation system 60, thereby permitting fluid movement through convection.

The heating source 144 may include a temperature differentiation driver 146 used to heat the fluid in at least a part of a ventilation system 60. It will be appreciated the temperature differentiation driver 146 may be any device, mechanism or system that works in conjunction with the heating source 144 to drive or create a temperature difference between the housing 130 and fluid in the flue 62. The temperature differentiation driver 146 may be electrically or chemically based. One example of an electrically based temperature differentiation driver may be heat tape that is electrically charged. One example of an electrically based temperature differentiation driver may a heating coil or heating element. One example of an electrically based temperature driver may be solar power that is harnessed into electricity and used to drive the temperature differentiation in the system. It will be appreciated that there are other examples of electrically based temperature differentiation drivers that may be used by the disclosure without departing from the spirit or scope of the disclosure.

Examples of chemically based temperature differentiation drivers may be petroleum, a petroleum based gel that will ignite and burn, natural gas, or natural gas components, such as methane, ethane, propane, butane and pentane. It will be appreciated that there are other examples of chemically based temperature differentiation drivers that may be used by the disclosure without departing from the spirit or scope of the disclosure. When using a chemical based temperature differentiation driver, the housing device 130 may include a gas attachment site and gas attachment mechanism for hooking the housing device 130 to a gas source, such as a natural gas line or other source, or the housing device 130 may include a basin 47 for holding liquids or gels. It will be appreciated that the natural gas hook up or the basin may be provided as part of the first portion 132, or the second portion 150 without departing from the spirit or scope of the disclosure.

The heat exchanger 140 may comprise a regulator, such as a timer device, such that the heat source 144 may be operable for a unit of time, for example between a range of about one minute to about ten minutes, and then is shut off by the regulator. The heat exchanger 140 may comprise a regulator, such as a thermal regulator, such that the heat source is operable until a certain temperature is reached and then is shut off by the regulator. It will be understood that the heating source 144 of the heat exchanger 140 may produce a temperature within a range of about 150 degrees to about 800 degrees Fahrenheit, thereby transferring heat energy from the heating source 144 to the fluid. The heat exchanger 140 may comprise a regulator that maintains a temperature differential, such that at a base 70 of the ventilation system 60 there is a greater temperature than at an exit 72 of the ventilation system 60, such that there is a continuous draw from the combustion device 20 to the exit 72 of the ventilation system 60.

Referring now to FIG. 8, wherein an embodiment of the housing device 230 is illustrated. The housing device 230 illustrated in FIG. 8 may comprise all or less than all of the features previously described in FIGS. 1-7. It will be appreciated that the embodiment of the disclosure illustrated in FIG. 8 contains many of the same structures represented in FIGS. 1-7. New or different structures will be explained to most succinctly describe the additional advantages that come with the embodiment of the disclosure illustrated in FIG. 8.

In this embodiment, the main body portion 231 may comprise a first tapered surface 231*a* and a second tapered surface 231*b*, which may be located at each end of the main body portion 231. The first portion 232 and the second portion 250 may each comprise a tapered surface 232*a* and 250*a*, respectively, at one end, that may be configured such that the tapered surface 232*a* of said first portion 232 may matingly engage the first tapered surface 231*a* of said main body portion 231 and the tapered surface 250*a* of said second portion 250 may matingly engage the second tapered surface 231*b* of said main body portion 231 to create a unitary device when assembled.

Figure 9:
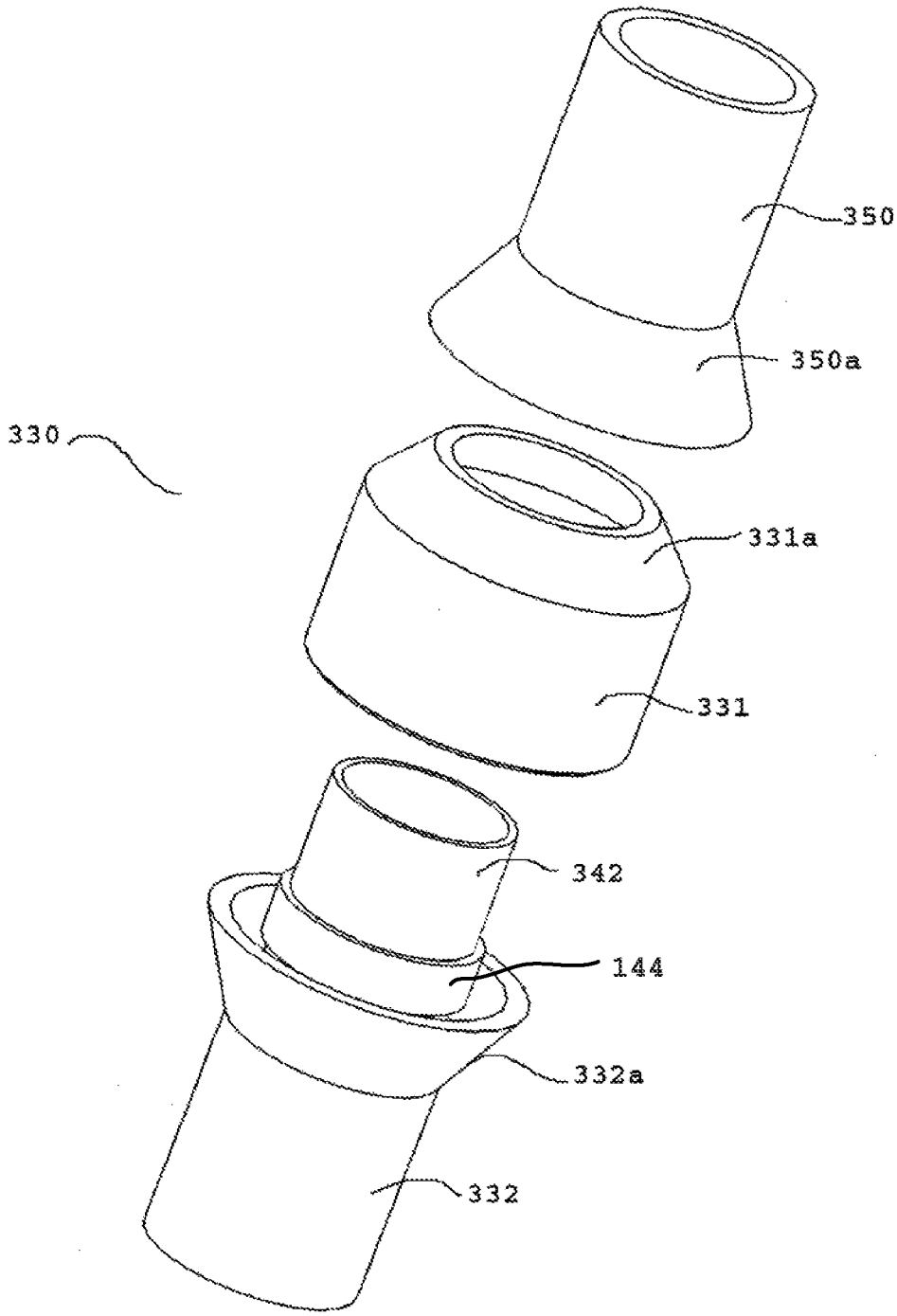
FIG. 9 is an exploded perspective view of a device for heating fluid in a flue in accordance with the principles of this disclosure.

Referring now to FIG. 9, wherein an embodiment of the housing device 330 is illustrated. The housing device 330 illustrated in FIG. 9 may comprise all or less than all of the features previously described in FIGS. 1-8. It will be appreciated that the embodiment of the disclosure illustrated in FIG. 9 contains many of the same structures represented in FIGS. 1-8. New or different structures will be explained to most succinctly describe the additional advantages that come with the embodiment of the disclosure illustrated in FIG. 9.

The main body portion 331 may comprise a first tapered surface 331*a* located at one end of the main body portion 331. The first portion 332 or the second portion 350 may comprise a tapered surface 332*a* or 350*a*, at one end, that may be configured such that the tapered surface 332*a* of the first portion 332 or the tapered surface 350*a* of the second portion 350 may matingly engage the first tapered surface 331*a* of said main body portion 331 to create a unitary device when assembled. The end opposite the first tapered surface 331*a* of the main body portion 331 may be shaped in a substantially cylindrical manner. However, it will be appreciated that other shapes other than cylindrical may also be used by the disclosure. Further, in FIG. 9 the elongated portion 342 does not comprise any vent holes 43, but it will be appreciated that such holes 43 may be present if desired.

Figure 10:
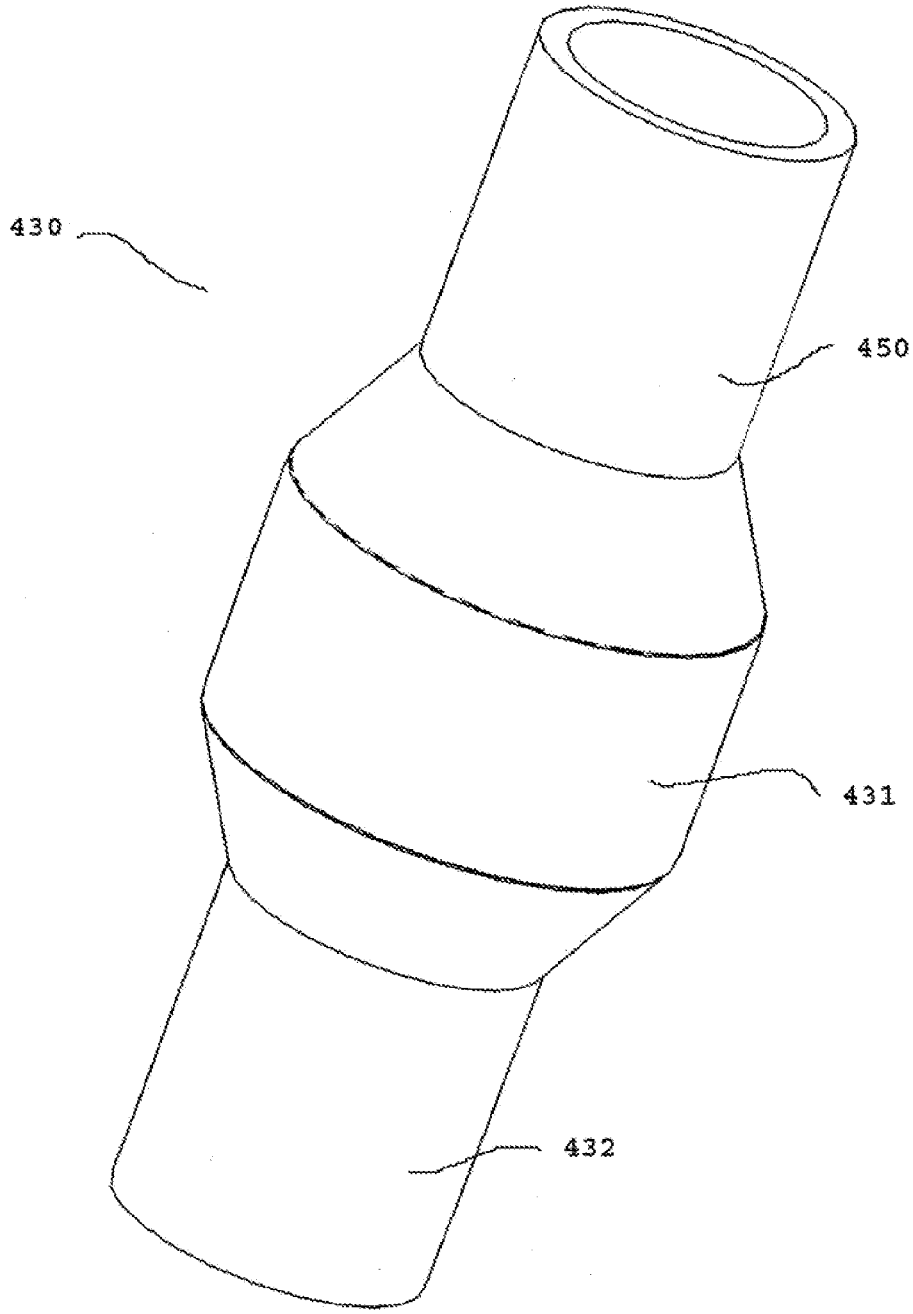
FIG. 10 is a perspective view of a device for heating fluid in a flue shown in a closed position in accordance with the principles of this disclosure.
Figure 11:
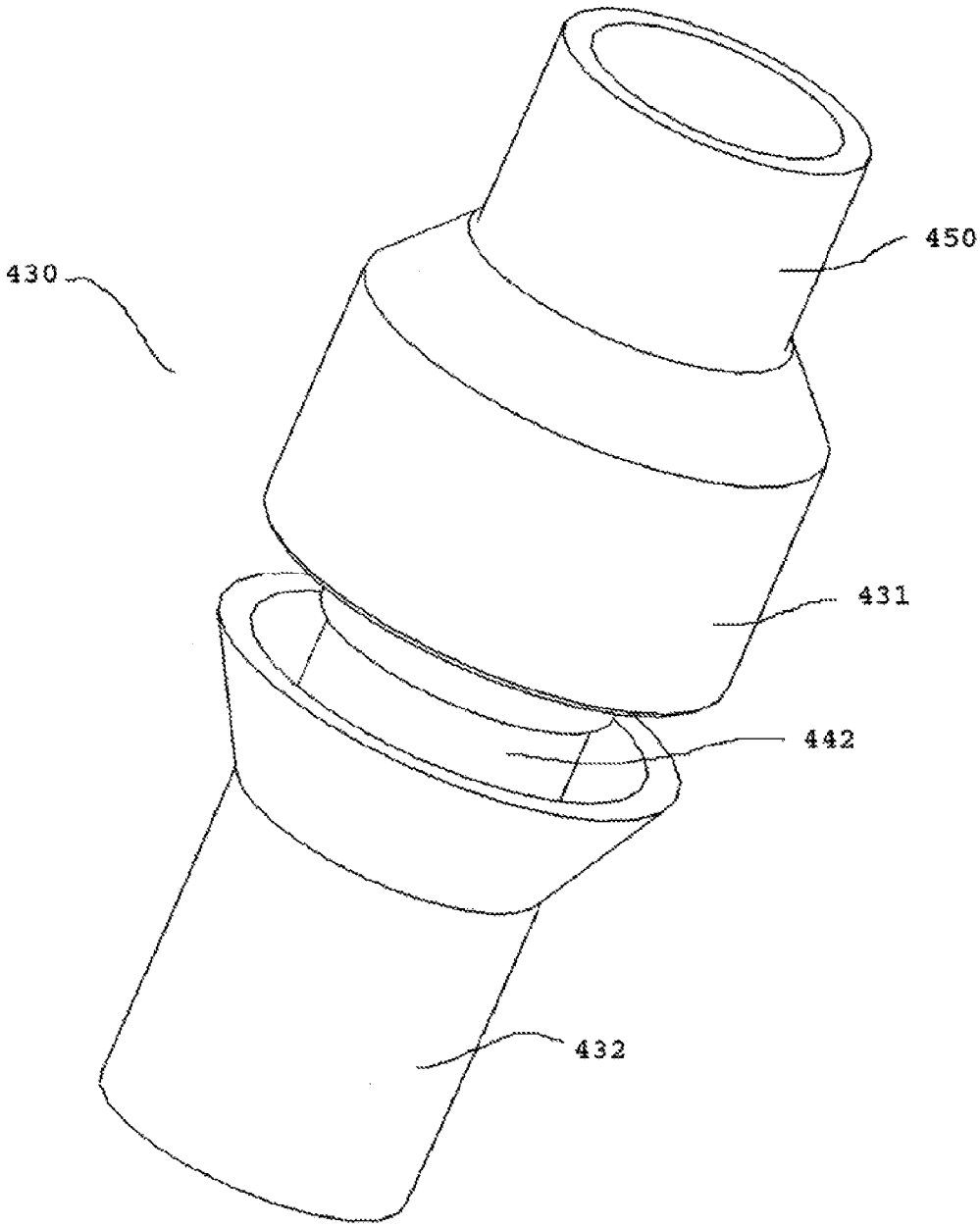
FIG. 11 is a perspective view of a device for heating fluid in a flue shown in a partially opened position in accordance with the principles of this disclosure.
Figure 12:
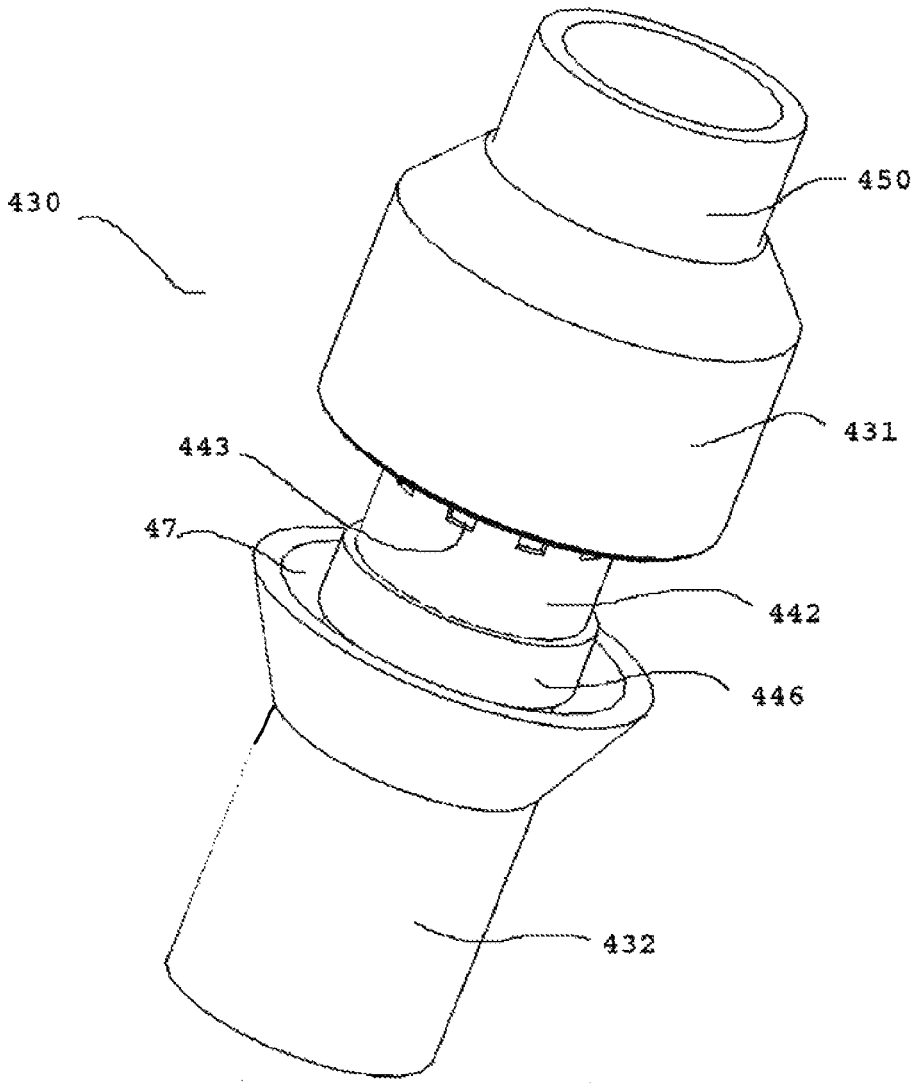
FIG. 12 is a perspective view of a device for heating fluid in a flue shown in an opened position in accordance with the principles of this disclosure.

Referring now to FIGS. 10-12, wherein an embodiment of the housing device 430 is illustrated. The housing device 430 illustrated in FIGS. 10-12 may comprise all or less than all of the features previously described in FIGS. 1-9. It will be appreciated that the embodiment of the disclosure illustrated in FIGS. 10-12 contains many of the same structures represented in FIGS. 1-9. New or different structures will be explained to most succinctly describe the additional advantages that come with the embodiment of the disclosure illustrated in FIGS. 10-12.

FIGS. 10-12 are a series of sequential drawings illustrating a housing device 430 beginning in a closed position in FIG. 10 and moving toward an opened position in FIG. 12. Specifically, FIG. 10 illustrates the housing device 430 in an assembled, closed position. FIG. 11 illustrates the housing device 430 in a partially opened position, while FIG. 12 illustrates the housing device 430 in an opened position. It will be appreciated that there may be various reasons for opening the housing device 430, for example there may be a need for accessing the components for repairs or other mechanical or electrical purposes. Further, when assembling the housing device 430 for integration about the flue 62 and combustion device 20, it may aid in the assembly process to have each of the component parts of the housing device 430 as separate, individual pieces.

Figure 13:
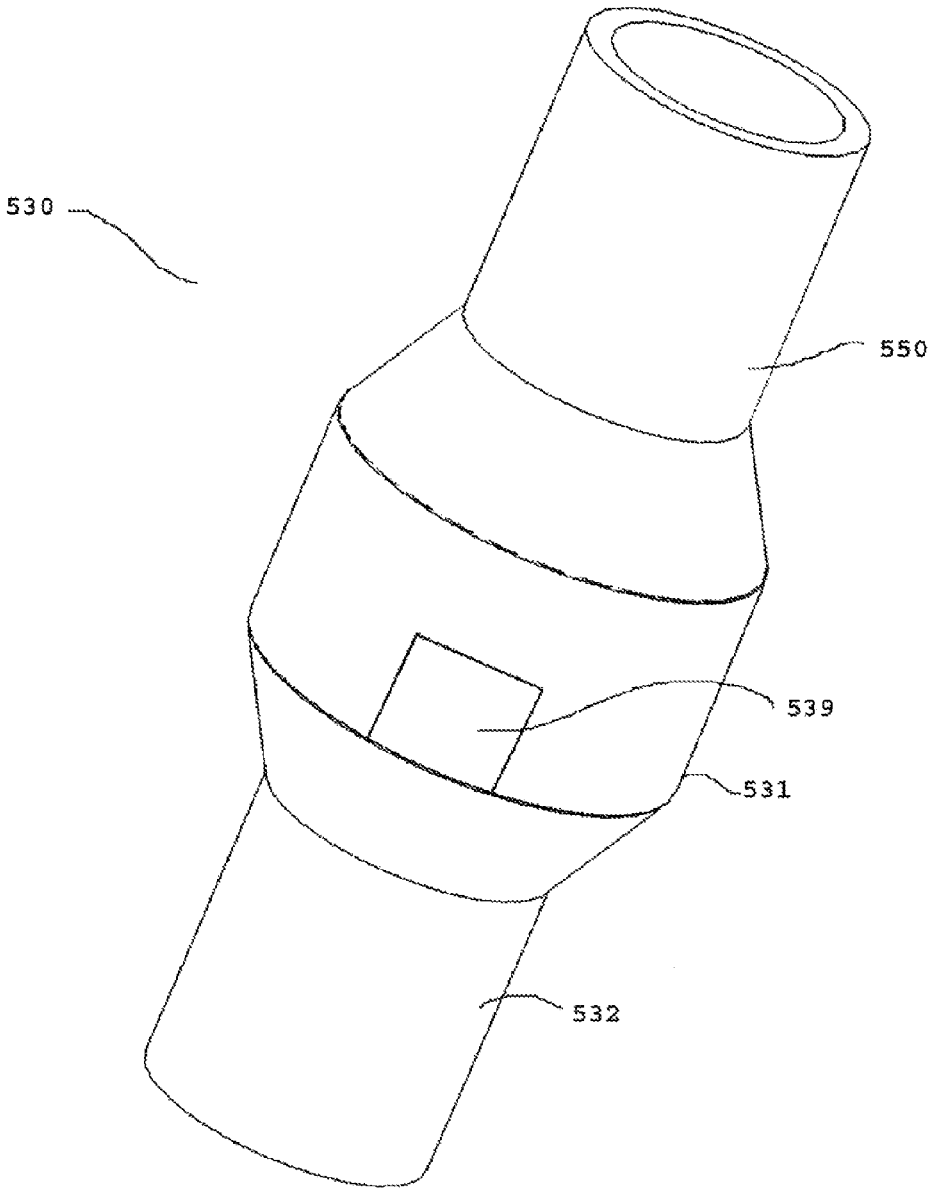
FIG. 13 is a perspective view of a device for heating fluid in a flue in accordance with the principles of this disclosure.

Referring now to FIG. 13, wherein an embodiment of the housing device 530 is illustrated. The housing device 530 illustrated in FIG. 13 may comprise all or less than all of the features previously described in FIGS. 1-12. It will be appreciated that the embodiment of the disclosure illustrated in FIG. 13 contains many of the same structures represented in FIGS. 1-12. New or different structures will be explained to most succinctly describe the additional advantages that come with the embodiment of the disclosure illustrated in FIG. 13. The housing device 530 may include an access door 539. It will be appreciated that there may be various reasons for having an access door 539 allowing a user to open the housing device 530. For example, there may be a need for accessing the components of the housing 530 for cleaning, repairs or other mechanical or electrical purposes or to provide a location to add an element of a temperature differentiation driver.

In accordance with the features and combinations described above, a useful method of heating fluid in a flue prior to combusting primary fuel in a primary combustion device, may comprise:

actuating a heat exchanger, wherein the heat exchanger has a heating source and is in thermal communication with fluid, such that heat energy is transferred between the heat exchanger and fluid;

selecting an interval of time for transferring heat energy;

waiting the selected interval of time, whereby sufficient heat energy is transferred between the heat exchanger and fluid;

actuating the primary fuel in the primary combustion device.

In the foregoing Detailed Description, various features of the disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description by this reference, with each claim standing on its own as a separate embodiment of the disclosure.

It is to be understood that the above-described arrangements are only illustrative of the application of the principles of the disclosure. Numerous modifications and alternative arrangements may be devised by those skilled in the art without departing from the spirit and scope of the disclosure and the appended claims are intended to cover such modifications and arrangements. Thus, while the disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A device for heating fluid in a flue prior to combusting primary fuel in a primary combustion device, comprising:

a housing assembly configured for integration about the flue, said housing assembly comprising:

a main body portion having a hollow and cylindrical center portion having a first end and a second end, a first frustoconical portion disposed on the first of the cylindrical center portion, a second frustoconical portion disposed on the second end of the cynlindrical center portion, and a heat exchanger having a heating source thermal communication with the flue wherein said heating source includes a temperature differentiation driver;

a first sleeve member having a first end configured and adapted for receiving a free end of a flue and a second end having a frustoconical portion disposed thereon;

a second sleeve member having a first end configured and adapted for receiving a free end of a flue and a second end having a frustoconical portion disposed thereon;

an elongated tubular portion extending from the second end of the first sleeve member such that the elongated tubular portion is disposed within the frustoconical portion disposed on the second end of the first sleeve member;

wherein the heat exchanger transfers heat energy from the heating source to a fluid constrained to a path created by the flue, thereby producing a pressure differential within the flue whereby the fluid is drawn out of the combustion device;

wherein the first frustoconical portion of the main body portion is configured to be directly received into the frustoconical portion of the first sleeve member and over the elongated tubular portion;

wherein the second frustoconical portion of the main body portion is configured to be directly received into the frustoconical portion of the second sleeve member;

wherein the elongated tubular portion is located in-line with respect to the flue so as to be integrated as part of the flue and is also located above the combustion device within a range of about one inch to about forty-eight inches such that at a base of the flue there is a greater temperature than at an exit of the flue when the heat exchanger is in operation;

wherein the heating source is in direct contact with the elongated portion of the first sleeve member thereby causing continual conduction of heat energy directly from the heating source into the flue; and wherein the heat exchanger is configured such that it causes heat energy transfer to heavier, more dense fluid contained within the flue prior to combusting the primary fuel in the primary combustion device.

2. The device of claim wherein the temperature differentiation driver is heat tape.

3. The device of claim 1, wherein the temperature differentiation driver is electrically based.

4. The device of claim 1, wherein the heat exchanger comprises a regulator, such that the heat source is operable for a unit of time and then is shut off by the regulator.

5. The device of claim 1, wherein the heat exchanger comprises a regulator, such that the heat source is operable until a certain temperature is reached and then is shut off by the regulator.

6. The device of claim 1, wherein the heating source of the heat exchanger produces a temperature within range of about 150 degrees to about 800 degrees Fahrenheit thereby transferring heat energy from said heating source to the fluid.

7. The device of claim 1, wherein the device further corn rises a regulator that maintains a temperature differential, such that at a base of the flue there is a greater temperature than at an exit of the flue, such that there is a continuous draw from the combustion device to said exit of the flue.

8. The device of claim 1, wherein the heat exchanger is configured such that it produces heat energy in a sufficient quantity to overcome an amount of heat energy leaving the device due to heat loss between the housing and the flue, thereby permitting fluid movement.

9. The device of claim 1, wherein the main body portion comprises at least a first tapered surface at one of its ends and wherein the first frustoconical portion comprises a second tapered surface and the second frustoconical portion comprises a third tapered surface, such that the second tapered surface of said first frustoconical portion or the third tapered surface of said second frustoconical portion matingly engages the first tapered surface of said main body portion to create a unitary device.

10. The device of claim 1, wherein the elongated portion comprises at least one hole for providing ventilation to the flue, thereby allowing heat energy to access an inner part of the flue, such that heat energy is transferred to the heavier, dense fluid inside the flue.

11. A system for heating fluid in a flue of a ventilation system prior to combusting primary fuel in a primary combustion device, comprising:

a combustion device comprising a chamber for combusting fuel;

a ventilation system connected to the combustion device and comprising a first flue portion and a second flue portion; and a housing assembly comprising:

a main body portion having a hollow and cylindrical center portion having a first end and a second end, a first frustoconical potion disposed on the first end of the cylindrical center portion a second frustoconical portion disposed on the second end of the cylindrical center portion, and a heat exchanger having a heating source in thermal communication with the flue wherein said heating source includes a temperature differentiation driver, a first sleeve member having a first end configured and adapted for receiving a free end of the first flue portion and a second end having a frustoconical portion disposed thereon, a second sleeve member having a first end configured and adapted for receiving a free end of the second fine portion and a second end having a frustoconical portion disposed thereon, an elongated tabular portion extending from the second end of the first sleeve member such that the elongated tubular portion is disposed within the frustoconical portion disposed on the second end of the first sleeve member, wherein the heat exchanger transfers heat member from the heating source to a fluid constrained to a path created by the flue, thereby a pressure differential within the flue whereby the fluid is drawn out of the combustion device, wherein the first frustoconical portion of the main body portion is configured to be directly received into the frustoconical portion of the first sleeve member and over the elongated tubular portion, wherein the second frustoconical portion of the main body portion is configured to be directly received into the frustoconical portions of the second sleeve member, wherein the elongated tubular portion is located in-line with respect to the flue so as to be integrated as part of the flue and is also located above the combustion device within a range of about one inch to about forty-eight inches such that at a base of the flue there is a greater temperature than at an exist of the flue when the heat exchanger is in operation, wherein the heating source is in direct contact with the elongated portion of the first sleeve member thereby causing continual conduction of heat energy directly from the heating source into the flue, and wherein the heat exchanger is configured such that it causes heat energy transfer to heavier, more dense fluid contained within the flue prior to combusting the primary fuel in the primary combustion device.

* * * * *